US008157712B1

(12) United States Patent
Musachio

(10) Patent No.: US 8,157,712 B1
(45) Date of Patent: Apr. 17, 2012

(54) RESISTANCE EXERCISE AND PHYSICAL THERAPY APPARATUS

(75) Inventor: Nicholas R. Musachio, St. Paul, MN (US)

(73) Assignee: Nicholas R. Musachio, St. Paul, MN (US)

( * ) Notice: Subject to any disclaimer, the term of this patent is extended or adjusted under 35 U.S.C. 154(b) by 0 days.

(21) Appl. No.: 12/962,974

(22) Filed: Dec. 8, 2010

(51) Int. Cl.
*A63B 21/02* (2006.01)

(52) U.S. Cl. ..... 482/121; 482/122; 482/124; 482/125

(58) Field of Classification Search ..... 482/121–131, 482/148
See application file for complete search history.

(56) References Cited

U.S. PATENT DOCUMENTS

| | | | | |
|---|---|---|---|---|
| 1,694,044 | A | 12/1928 | Thompson | |
| 3,701,531 | A | 10/1972 | Bowers | |
| 3,785,643 | A | 1/1974 | Rich | |
| 4,869,499 | A | 9/1989 | Schiraldo | |
| 5,039,093 | A | 8/1991 | Collier | |
| 5,186,698 | A | 2/1993 | Mason et al. | |
| 6,206,807 | B1 | 3/2001 | Cowans et al. | |
| 6,540,651 | B1 | 4/2003 | Aberton et al. | |
| 6,808,175 | B1 | 10/2004 | Gleeson | |
| 7,087,003 | B1 | 8/2006 | Katterjohn | |
| 7,448,990 | B2 * | 11/2008 | Wu | 482/121 |
| 2005/0269784 | A1 | 12/2005 | Peters | |
| 2006/0094573 | A1 * | 5/2006 | Weck | 482/126 |
| 2009/0111662 | A1 * | 4/2009 | Wagner et al. | 482/45 |

* cited by examiner

*Primary Examiner* — Glenn Richman
(74) *Attorney, Agent, or Firm* — Fish & Richardson P.C.

(57) ABSTRACT

A resistance exercise and physical therapy apparatus is provided. The resistance exercise and physical therapy apparatus includes: an elongate resilient member having a proximal end and a distal end, wherein the elongate resilient member includes an elastic material with a first enlargement at the proximal end, a second enlargement at the distal end, and one or more spaced-apart third enlargements along the length of the elongate resilient member, wherein the first enlargement is grasped by a first foot of a human user or by one or more floor or wall mounted sockets. A method of resistance exercise and a kit including the resistance exercise and physical therapy apparatus are also provided.

20 Claims, 6 Drawing Sheets

RESISTANCE EXERCISE AND PHYSICAL THERAPY APPARATUS

BACKGROUND OF THE INVENTION

Physical exercise is beneficial to human health in many way including, for example, improved circulation, increased immunity, greater physical strength, and endurance. Resistance and flexibility training exercises help develop muscle tone while providing other valuable health benefits.

Typically, elastic bands and surgical tubing are used for resistance exercise and physical therapy. There are numerous complaints about the bands and tubes digging into or burning the user's hands, feet, and back. Some devices include handles, but it may be difficult to insert a foot or a hand through the handle. In addition, resistance cords can easily slip off a foot or a hand and become a safety hazard.

Plantar fasciitis is a problem that affects millions of people and can be quite debilitating. Everyday activities, for example, walking and standing can be are very painful. Plantar fasciitis is often treated by stretching the plantar fascia, the soleus, the gastrocnemius muscles of the lower leg, or a combination thereof.

What is needed is a resistance exercise and physical therapy apparatus that can be used for Pilate's exercises or for physical therapy of conditions such as Plantar fasciitis.

SUMMARY OF THE INVENTION

The present invention provides a resistance exercise and physical therapy apparatus in the form of an elongate resilient member that has significant advantages over the existing devices. For example, a toe hold on the elongate resilient member allows for a greater number of exercise movements without fear that the elongate resilient member will slide off the foot and hit the user. By engaging the bones instead of the skin, the elongate resilient member can be stretched at higher tensions without burning the skin between the user's toes. Further, the elongate resilient member with a novel toe hold cannot easily be dislodged. This allows for a wide variety of novel stretches and moves not possible or safe with the existing bands, tubes, strapped cords, or bolo cords. Further, an elongate resilient member with a ball on the end is not comfortable or stable to grasp by the toes because it affects the balance of the user when standing. On the other hand, the resistance exercise and physical therapy apparatus, as provided by the present invention, has a unique shape that allows for the user to comfortably stand and be held by the toes. However, unlike a bolo device, which has a large mass on the terminal ends and is harder to grasp, the resistance exercise and physical therapy apparatus is very easy to grasp with the minimal mass at the terminal ends.

The present invention also provides a resistance exercise and physical therapy apparatus in the form of an elongate resilient member that is specially molded resistance cord to be easily grasped by the user's toes, for example, between the big toe and the second toe. Additionally, the elongate resilient member has spaced molded thickenings. The thickenings act as stops for the elongate resilient member. In one embodiment, one end of the cord is grasped by the foot and the other end is grasped by the hand. This design allows cord to be squeezed in the webbing between the stricture created by the flesh and bones of the thumb and index fingers or by the flesh and bones of the hand grasping the molded thickenings. The toe grasping portions of the elongate resilient member are widened and flattened on the bottom so that the user may stand comfortably grasping the cord between their toes, with their feet flat on the floor. In this manner, the toe grasping portion does not affect the balance of the user. Further, the user may adjust the height and the tension of the resistance exercise and physical therapy apparatus by grasping the elongate resilient member at various thickenings. The spaced balls provide an improved means of grasping the elongate resilient member, as they provide a slip-proof means of holding the elongate resilient member.

The present invention provides a resistance exercise and physical therapy apparatus. The resistance exercise and physical therapy apparatus includes: an elongate resilient member having a proximal end and a distal end, wherein the elongate resilient member includes an elastic material with a first enlargement at the proximal end, a second enlargement at the distal end, and one or more spaced-apart third enlargements along the length of the elongate resilient member, wherein the first enlargement is grasped by a first foot of a human user or by one or more floor or wall mounted sockets.

In one embodiment, the first enlargement is grasped between the big toe and the second toe on the first foot of a human user and occupies the cavity formed by the big toe and the second toe. In one embodiment, the first enlargement does not interfere with the comfort and the balance of the user when the human user is standing on the first foot. In one embodiment, the first enlargement has a first flat surface that conforms to the surface of a floor that the human user is standing on with the first foot.

In one embodiment, the first flat surface includes a first non-slip surface. In one embodiment, the second enlargement or one or more spaced apart third enlargements is grasped by one or more hands of the human user. In one embodiment, the second enlargement is grasped by a second foot of the human user.

In one embodiment, the second enlargement is grasped between the big toe and the second toe of the second foot of the human user. In one embodiment, the second enlargement does not interfere with the comfort and the balance of the user when the human user is standing on the second foot. In one embodiment, the second enlargement has a second flat surface that conforms to the surface of a floor that the human user is standing on with the second foot.

In one embodiment, the resistance exercise and physical therapy apparatus further includes one or more handles attached to the first enlargement, the second enlargement, the third enlargement, or a combination thereof. In one embodiment, the second flat surface includes a second non-slip surface.

In one embodiment, the human user begins an exercise routine such that the second enlargement is grasped by a hand or a foot of the human user and pulled in a direction away from the first foot.

In one embodiment, the human user begins an exercise routine such that the one or more spaced apart third enlargements are grasped by a hand of the human user and pulled in a direction away from the first foot. In one embodiment, the human user begins an exercise routine such that the second enlargement is grasped by the second foot of the human user, and the one or more spaced apart third enlargements are grasped by a hand of the human user and pulled in a direction away from the first and second feet of the human user.

In one embodiment, the elongate resilient member has a length greater than about twelve inches but less than about sixty inches. In one embodiment, the elongate resilient member has a length greater than about twenty-four inches but less than about forty-eight inches. In one embodiment, the first enlargement, the second enlargement, and the one or more spaced apart third enlargements each independently include a first elastic material, a knot of elastic material, a wooden material, a metal material, a plastic material, a second elastic material, a third elastic material, or a combination thereof.

In one embodiment, the resistance exercise and physical therapy apparatus further includes one or more tubular pads are independently interspaced between the first enlargement, the second enlargement, the one or more spaced apart third enlargements, or a combination thereof, wherein the one or more tubular pads independently sheath the elongate resilient member.

In one embodiment, the first enlargement, the second enlargement, and the one or more spaced apart third enlargements each have equal thicknesses. In one embodiment, the first enlargement, the second enlargement, and the one or more spaced apart third enlargements each have different thicknesses. In one embodiment, the first enlargement and the second enlargement each have equal thicknesses and the one or more spaced apart third enlargements each have a thickness different from the first enlargement and the second enlargement.

In one embodiment, the resistance exercise and physical therapy apparatus further includes one or more handles attached to the elongate resilient member. In one embodiment, the one or more handles are attached to the second enlargement or the one or more spaced apart third enlargements. In one embodiment, the one or more handles are attached to elongate resilient member in between first enlargement, the second enlargement, the one or more spaced apart third enlargement, or a combination thereof.

In one embodiment, the one or more handles independently include a strap, a stretch band, a sleeve slider, or a combination thereof. In one embodiment, the one or more floor or wall mounted sockets each independently include one or more keyhole connectors, one or more adjustable clamps, one or more strictures, one or more slots, one or more grommets, one or more captures, or combinations thereof.

In one embodiment, the one or more floor or wall mounted sockets each independently include one or more keyhole connectors.

In one embodiment, the exercise is a Pilates stretching exercise. In one embodiment, the physical therapy is for plantar fasciitis. In one embodiment, the physical therapy is for Achilles tendonitis.

The present invention provides a resistance exercise and physical therapy apparatus. The resistance exercise and physical therapy apparatus includes: an elongate resilient member having a proximal end and a distal end, wherein the elongate resilient member includes an elastic material with a first enlargement at the proximal end, a second enlargement at the distal end, and one or more spaced-apart third enlargements along the length of the elongate resilient member, wherein the first enlargement is grasped by a first foot of a human user.

In one embodiment, the first enlargement is grasped between the big toe and the second toe on the first foot of a human user and occupies the cavity formed by the big toe and the second toe. In one embodiment, the first enlargement does not interfere with the comfort and the balance of the user when the human user is standing on the first foot. In one embodiment, the first enlargement has a first flat surface that conforms to the surface of a floor that the human user is standing on with the first foot.

In one embodiment, the flat surface includes a first non-slip surface. In one embodiment, the second enlargement or one or more spaced apart third enlargements is grasped by one or more hands of the human user. In one embodiment, the second enlargement is grasped by a second foot of the human user.

In one embodiment, the second enlargement is grasped between the big toe and the second toe of the second foot of the human user. In one embodiment, the second enlargement does not interfere with the comfort and the balance of the user when the human user is standing on the second foot. In one embodiment, the second enlargement has a second flat surface that conforms to the surface of a floor that the human user is standing on with the second foot.

In one embodiment, the second flat surface includes a second non-slip surface. In one embodiment, the human user begins an exercise routine such that the second enlargement is grasped by a hand of the human user and pulled in a direction away from the first foot. In one embodiment, the human user begins an exercise routine such that the one or more spaced apart third enlargements are grasped by a hand of the human user and pulled in a direction away from the first foot.

In one embodiment, the human user begins an exercise routine such that the second enlargement is grasped by the second foot of the human user, and the one or more spaced apart third enlargements are grasped by a hand of the human user and pulled in a direction away from the first and second feet of the human user.

The present invention provides a resistance exercise and physical therapy apparatus. The resistance exercise and physical therapy apparatus includes: an elongate resilient member having a proximal end and a distal end, wherein the elongate resilient member includes an elastic material with a first enlargement at the proximal end, a second enlargement at the distal end, and one or more spaced-apart third enlargements along the length of the elongate resilient member, wherein the first enlargement is grasped by one or more floor or wall mounted sockets.

In one embodiment, the second enlargement or one or more spaced apart third enlargements is grasped by one or more hands of the human user. In one embodiment, the second enlargement is grasped by a foot of the human user. In one embodiment, the second enlargement is grasped between the big toe and the second toe of the foot of the human user.

In one embodiment, the human user begins an exercise routine such that the second enlargement is grasped by a hand of the human user and pulled in a direction away from the one or more floor or wall mounted sockets. In one embodiment, the human user begins an exercise routine such that the one or more spaced apart third enlargements are grasped by a hand of the human user and pulled in a direction away from the one or more floor or wall mounted sockets.

In one embodiment, the one or more floor or wall mounted sockets each independently include one or more keyhole connectors, one or more adjustable clamps, one or more strictures, one or more slots, one or more grommets, one or more captures, or combinations thereof. In one embodiment, the one or more floor or wall mounted sockets each independently include one or more keyhole connectors.

The present invention provides a method of resistance exercise and physical therapy. The method includes: providing a resistance exercise and physical therapy apparatus including: an elongate resilient member having a proximal end and a distal end, wherein the elongate resilient member includes an elastic material with a first enlargement at the proximal end, a second enlargement at the distal end, and one or more spaced-apart third enlargements along the length of the elongate resilient member, wherein the first enlargement is grasped by a first foot of a human user or by a floor or wall mounted socket; grasping the first enlargement between the big toe and the second toe on the first foot of a human user or inserting the first enlargement into a floor or wall mounted socket; grasping the second enlargement or the one or more spaced apart third enlargements by a hand of the human user; and pulling the second enlargement or the one or more spaced apart third enlargements in a direction away from the first foot of the human user or the floor or wall mounted socket so that the elongate resilient member is under tension.

In one embodiment, the method further includes directing the second enlargement or the one or more spaced apart third enlargements in a direction toward the first foot of the human user or the floor or wall mounted socket to release the tension on the elongate resilient member.

The present invention provides a method of resistance exercise and physical therapy. The method includes: providing a resistance exercise and physical therapy apparatus including: an elongate resilient member having a proximal end and a distal end, wherein the elongate resilient member includes an elastic material with a first enlargement at the proximal end, a second enlargement at the distal end, and one or more spaced-apart third enlargements along the length of the elongate resilient member, wherein the first enlargement is grasped by a first foot of a human user or by a floor or wall mounted socket; grasping the first enlargement between the big toe and the second toe of a human user or inserting the first enlargement into a floor or wall mounted socket; grasping the second enlargement or the one or more spaced apart third enlargements by a hand of the human user; and pulling the second enlargement or the one or more spaced apart third enlargements in a direction away from the first foot of the human user so that the elongate resilient member is under tension.

In one embodiment, the method further includes directing the second enlargement or the one or more spaced apart third enlargements in a direction toward the first foot of the human user or the floor or wall mounted socket to release the tension on the elongate resilient member.

The present invention provides a method of resistance exercise and physical therapy. The method includes: providing a resistance exercise and physical therapy apparatus including: an elongate resilient member having a proximal end and a distal end, wherein the elongate resilient member includes an elastic material with a first enlargement at the proximal end, a second enlargement at the distal end, and one or more spaced-apart third enlargements along the length of the elongate resilient member, wherein the first enlargement is grasped by a floor or wall mounted socket; inserting the first enlargement into a floor or wall mounted socket; grasping the second enlargement or the one or more spaced apart third enlargements by a hand of the human user; and pulling the second enlargement or the one or more spaced apart third enlargements in a direction away from the floor or wall mounted socket so that the elongate resilient member is under tension.

In one embodiment, the method further includes directing the second enlargement or the one or more spaced apart third enlargements in a direction toward the floor or wall mounted socket to release the tension on the elongate resilient member.

The present invention provides a method of resistance exercise and physical therapy. The method includes: providing a resistance exercise and physical therapy apparatus including: an elongate resilient member having a proximal end and a distal end, wherein the elongate resilient member includes an elastic material with a first enlargement at the proximal end, a second enlargement at the distal end, and one or more spaced-apart third enlargements along the length of the elongate resilient member, wherein the first enlargement is grasped by a first foot of a human user; grasping the first enlargement between the big toe and the second toe on the first foot of a human user; grasping the second enlargement between the big toe and the second toe on the second foot of a human user; grasping the one or more spaced apart third enlargements by a hand of the human user; and pulling the one or more spaced apart third enlargements in a direction away from the first foot of the human user so that the elongate resilient member is under tension.

In one embodiment, the method further includes directing the one or more spaced apart third enlargements in a direction toward the first foot of the human user to release the tension on the elongate resilient member.

The present invention also provides a method of Pilates exercise including providing a resistance exercise and physical therapy apparatus including: an elongate resilient member having a proximal end and a distal end, wherein the elongate resilient member includes an elastic material with a first enlargement at the proximal end, a second enlargement at the distal end, and one or more spaced-apart third enlargements along the length of the elongate resilient member, wherein the first enlargement is grasped by a first foot of a human user or by a floor or wall mounted socket; grasping the first enlargement between the big toe and the second toe on the first foot of a human user or inserting the first enlargement into a floor or wall mounted socket; grasping the second enlargement or the one or more spaced apart third enlargements by a hand or a foot of the human user; and pulling the second enlargement or the one or more spaced apart third enlargements in a direction away from the first foot of the human user or the floor or wall mounted socket so that the elongate resilient member is under tension.

The present invention also provides a method of stretching including providing a resistance exercise and physical therapy apparatus including: an elongate resilient member having a proximal end and a distal end, wherein the elongate resilient member includes an elastic material with a first enlargement at the proximal end, a second enlargement at the distal end, and one or more spaced-apart third enlargements along the length of the elongate resilient member, wherein the first enlargement is grasped by a first foot of a human user or by a floor or wall mounted socket; grasping the first enlargement between the big toe and the second toe on the first foot of a human user or inserting the first enlargement into a floor or wall mounted socket; grasping the second enlargement or the one or more spaced apart third enlargements by a hand or a foot of the human user; and pulling the second enlargement or the one or more spaced apart third enlargements in a direction away from the first foot of the human user or the floor or wall mounted socket so that the elongate resilient member is under tension.

The present invention also provides a method of resistance exercise including providing a resistance exercise and physical therapy apparatus including: an elongate resilient member having a proximal end and a distal end, wherein the elongate resilient member includes an elastic material with a first enlargement at the proximal end, a second enlargement at the distal end, and one or more spaced-apart third enlargements along the length of the elongate resilient member, wherein the first enlargement is grasped by a first foot of a human user or by a floor or wall mounted socket; grasping the first enlargement between the big toe and the second toe on the first foot of a human user or inserting the first enlargement into a floor or wall mounted socket; grasping the second enlargement or the one or more spaced apart third enlargements by a hand or a foot of the human user; and pulling the second enlargement or the one or more spaced apart third enlargements in a direction away from the first foot of the human user or the floor or wall mounted socket so that the elongate resilient member is under tension.

The present invention also provides a method of physical therapy including providing a resistance exercise and physical therapy apparatus including: an elongate resilient member having a proximal end and a distal end, wherein the elongate resilient member includes an elastic material with a first enlargement at the proximal end, a second enlargement at the distal end, and one or more spaced-apart third enlargements along the length of the elongate resilient member, wherein the first enlargement is grasped by a first foot of a human user or by a floor or wall mounted socket; grasping the first enlargement between the big toe and the second toe on the first foot of a human user or inserting the first enlargement into a floor or wall mounted socket; grasping the second enlargement or the one or more spaced apart third enlargements by a hand or a foot of the human user; and pulling the second enlargement or the one or more spaced apart third enlargements in a direction away from the first foot of the human user or the floor or wall mounted socket so that the elongate resilient member is under tension.

The present invention provides a resistance exercise and physical therapy kit. The kit includes a resistance exercise and physical therapy apparatus including an elongate resilient member having a proximal end and a distal end, wherein the elongate resilient member includes an elastic material with a first enlargement at the proximal end, a second enlargement at the distal end, and one or more spaced-apart third enlargements along the length of the elongate resilient member, wherein the first enlargement is grasped by a first foot of a human user or by one or more floor or wall mounted sockets; and a set of instructions that instruct the human user how to perform specific exercises or physical therapies.

BRIEF DESCRIPTION OF THE DRAWINGS

Embodiments of the invention may be best understood by referring to the following description and accompanying drawings, which illustrate such embodiments. In the drawings.

Figure 1:
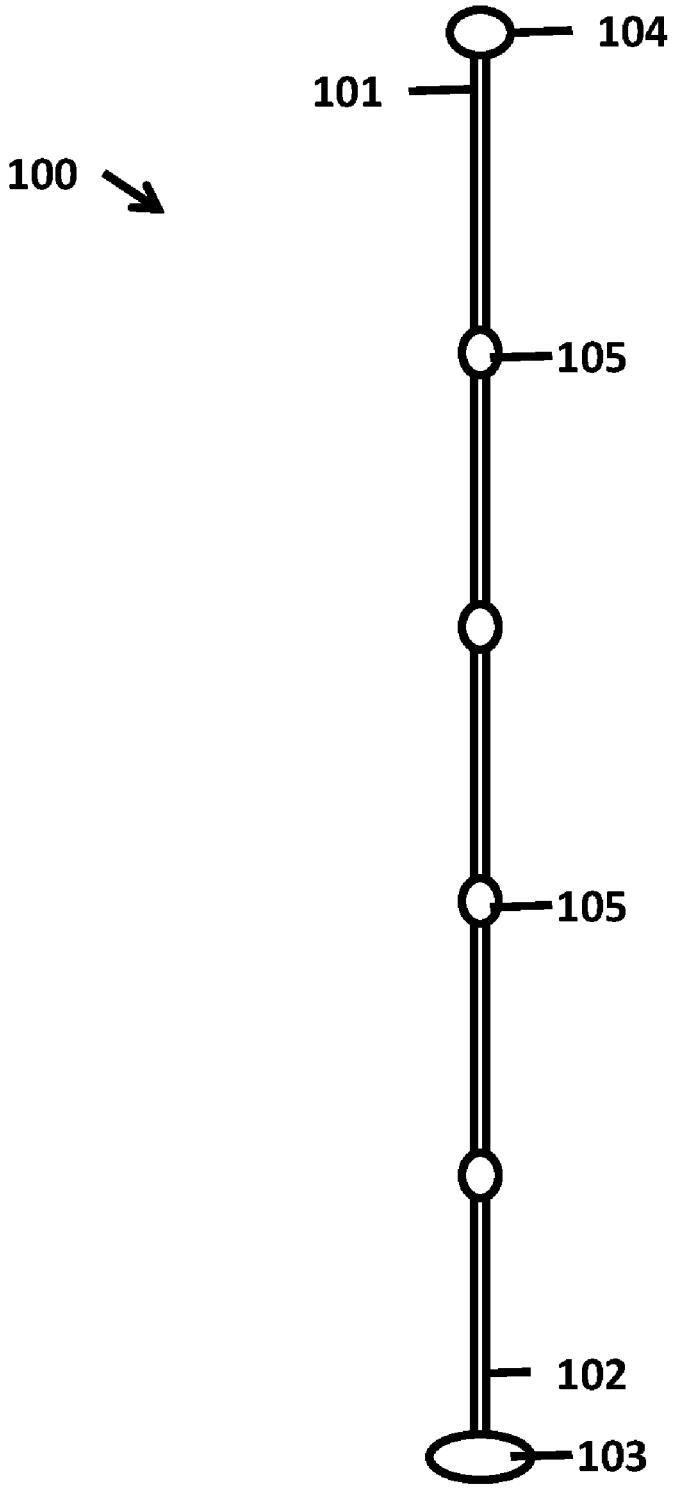
FIG. 1 is a front-view drawing illustrating an exemplary resistance exercise and physical therapy apparatus.

The drawings are not necessarily to scale. Like numbers used in the figures refer to like components, steps, and the like. However, it will be understood that the use of a number to refer to a component in a given figure is not intended to limit the component in another figure labeled with the same number.

DETAILED DESCRIPTION OF THE INVENTION

The present invention provides a resistance exercise and physical therapy apparatus in the form of an elongate resilient member that has significant advantages over the existing devices. For example, a toe hold on the elongate resilient member allows for a greater number of exercise movements without fear that the elongate resilient member will slide off the foot and hit the user. By engaging the bones instead of the skin, the elongate resilient member can be stretched at higher tensions without burning the skin between the user's toes. Further, the elongate resilient member with a novel toe hold cannot easily be dislodged. This allows for a wide variety of novel stretches and moves not possible or safe with the existing bands, tubes, strapped cords, or bolo cords. Further, an elongate resilient member with a ball on the end is not comfortable or stable to grasp by the toes because it affects the balance of the user when standing. On the other hand, the resistance exercise and physical therapy apparatus, as provided by the present invention, has a unique shape that allows for the user to comfortably stand and be held by the toes. However, unlike a bolo device, which has a large mass on the terminal ends and is harder to grasp, the resistance exercise and physical therapy apparatus is very easy to grasp with the minimal mass at the terminal ends.

The present invention also provides a resistance exercise and physical therapy apparatus in the form of an elongate resilient member that is specially molded resistance cord to be easily grasped by the user's toes, for example, between the big toe and the second toe. Additionally, the elongate resilient member has spaced molded thickenings. The thickenings act as stops for the elongate resilient member. In one embodiment, one end of the cord is grasped by the foot and the other end is grasped by the hand. This design allows cord to be squeezed in the webbing between the stricture created by the flesh and bones of the thumb and index fingers or by the flesh and bones of the hand grasping the molded thickenings. The toe grasping portions of the elongate resilient member are widened and flattened on the bottom so that the user may stand comfortably grasping the cord between their toes, with their feet flat on the floor. In this manner, the toe grasping portion does not affect the balance of the user. Further, the user may adjust the height and the tension of the resistance exercise and physical therapy apparatus by grasping the elongate resilient member at various thickenings. The spaced balls provide an improved means of grasping the elongate resilient member, as they provide a slip-proof means of holding the elongate resilient member.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense, and the scope of the present invention is defined by the appended claims and their equivalents.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the claims made herein.

Methods recited herein may be carried out in any order of the recited events which is logically possible, as well as the recited order of events. Furthermore, where a range of values is provided, it is understood that every intervening value, between the upper and lower limit of that range and any other stated or intervening value in that stated range is encompassed within the invention. Also, it is contemplated that any optional feature of the inventive variations described may be set forth and claimed independently, or in combination with any one or more of the features described herein.

The referenced items are provided solely for their disclosure prior to the filing date of the present application. Nothing herein is to be construed as an admission that the present invention is not entitled to antedate such material by virtue of prior invention.

Unless otherwise indicated, the words and phrases presented in this document have their ordinary meanings to one of skill in the art. Such ordinary meanings can be obtained by reference to their use in the art and by reference to general and scientific dictionaries, for example, *Webster's Third New International Dictionary*, Merriam-Webster Inc., Springfield, Mass., 1993 and *The American Heritage Dictionary of the English Language*, Houghton Mifflin, Boston Mass., 1981.

The following explanations of certain terms are meant to be illustrative rather than exhaustive. These terms have their ordinary meanings given by usage in the art and in addition include the following explanations.

As used herein, the term "Achilles tendonitis" refers to an inflammation of the Achilles tendon, the tough sinew that attaches the calf muscle to the back of the calcaneus or heel bone.

As used herein, the term "about" refers to a variation of 10 percent of the value specified; for example about 50 percent carries a variation from 45 to 55 percent.

As used herein, the term "and/or" refers to any one of the items, any combination of the items, or all of the items with which this term is associated.

As used herein, the singular forms "a," "an," and "the" include plural reference unless the context clearly dictates otherwise. It is further noted that the claims may be drafted to exclude any optional element. As such, this statement is intended to serve as antecedent basis for use of such exclusive terminology as "solely," "only," and the like in connection with the recitation of claim elements, or use of a "negative" limitation.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

As used herein, the terms "include," "for example," "such as," and the like are used illustratively and are not intended to limit the present invention.

As used herein, the term "plantar fasciitis" refers to an inflammation of the plantar fascia (fasciitis), the "bowstring-like" tissue in the sole of the foot stretching from the heel to the front of the foot.

As used herein, the term "Pilates exercise" refers to the exercise method developed by Joseph H. Pilates. This method involves some principles known from yoga, and hundreds of exercises utilizing a wide variety of specially designed equipment employing a fusion of various philosophies of body culture, movement, body mechanics, balance, coordination, positioning, strength and flexibility, aiming at improved fitness, enhanced performance, and improved posture and flexibility with low impact.

As used herein, the term "physical therapy" refers to the treatment of physical dysfunction or injury by the use of therapeutic exercise and the application of modalities, intended to restore or facilitate normal function or development.

As used herein, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the term "resistance exercise" refers to an exercise performed against an opposing force, designed to increase muscle strength; the resistance may be either isometric, isotonic, or isokinetic.

As used herein, the terms "front," "back," "rear," "upper," "lower," "right," and "left" in this description are merely used to identify the various elements as they are oriented in the FIGS, with "front," "back," and "rear" being relative apparatus. These terms are not meant to limit the element which they describe, as the various elements may be oriented differently in various applications.

FIG. 1 is a front-view drawing illustrating an exemplary resistance exercise and physical therapy apparatus. The resilient member 100 having a base end 101 and a remote end 102. The resilient member 100 includes a first enlargement 103 at the base end, a second enlargement 104 at the distal end, and spaced-apart third enlargements 105 along the length of the resilient member 100. The first enlargement 103, the second enlargement 104, and the spaced-apart third enlargements 105 each have an oval shape.

In one embodiment, the resilient member 100 may be made of, for example, a styrene-butadiene rubber or a chloroprene (i.e., neoprene) rubber. The resilient member 100 has excellent memory characteristics and returns to its original shape after numerous elongations.

The resilient member 100 may also be made of any other suitable elastic material, for example, natural rubber, synthetic polyisoprene, butyl rubber, halogenated butyl rubber, polybutyldiene, nitrile butadiene rubber, hydrogenated nitrile rubber, ethylene propylene rubber, epichlorohydrin rubber, polyacrylic rubber, silicone rubber, fluorosilicon rubber, fluoroelastomers, prefluoroelastomers, thermoplastic polyurethane, polyether block amides, chlorosulfonated polyethylene, ethylene-vinyl acetate, and the like, or combinations thereof.

Typical physical properties for a suitable elastic material includes, for example, a polymer specific gravity from about 0.8 to about 2.0, a tensile strength (in pounds per square inch) from about 1000 to about 9000, and a percentage elongation to about 900. The elastic material should also possess, for example, good abrasion resistance, good tear resistance, and good ozone resistance.

In one embodiment, the exemplary resilient member 100 may be, for example, a bungee cord, which is an elastic cord composed of one or more elastic strands forming a core, usually covered in a woven nylon or cotton sheath.

In one embodiment, the first enlargement 103, the second enlargement 104, and each of the one or more spaced-apart third enlargements 105 is made of the elastic material. In one embodiment, the first enlargement 103 and the second enlargement 104 are each made of the elastic material and each of the one or more spaced-apart enlargements 105 are made of a wooden material. In one embodiment, first enlargement 103 and the second enlargement 104 are each made of the elastic material and each of the one or more spaced-apart third enlargements 105 are made of a metal material.

In one embodiment, the first enlargement 103 and the second enlargement 104 are each made of the elastic material and each of the one or more spaced-apart third enlargements 105 are made of a plastic material. In one embodiment, the first enlargement 103 is made of the elastic material and the second enlargement 104 and each of the one or more spaced-apart enlargements 105 are made of a different elastic material. In one embodiment, first enlargement 103 and the second enlargement 104 are each made of a wooden material and each of the one or more spaced-apart third enlargements 105 are made of an elastic material.

In one embodiment, the first enlargement 103 and the second enlargement 104, and each of the one or more spaced-apart enlargements 105 are made of a wooden material. In one embodiment, the first enlargement 103 and the second enlargement 104, and each of the one or more spaced-apart enlargements 105 are made of a metal material. In one embodiment, the first enlargement 103 and the second enlargement 104, and each of the one or more spaced-apart enlargements 105 are made of a plastic material.

Figure 2:
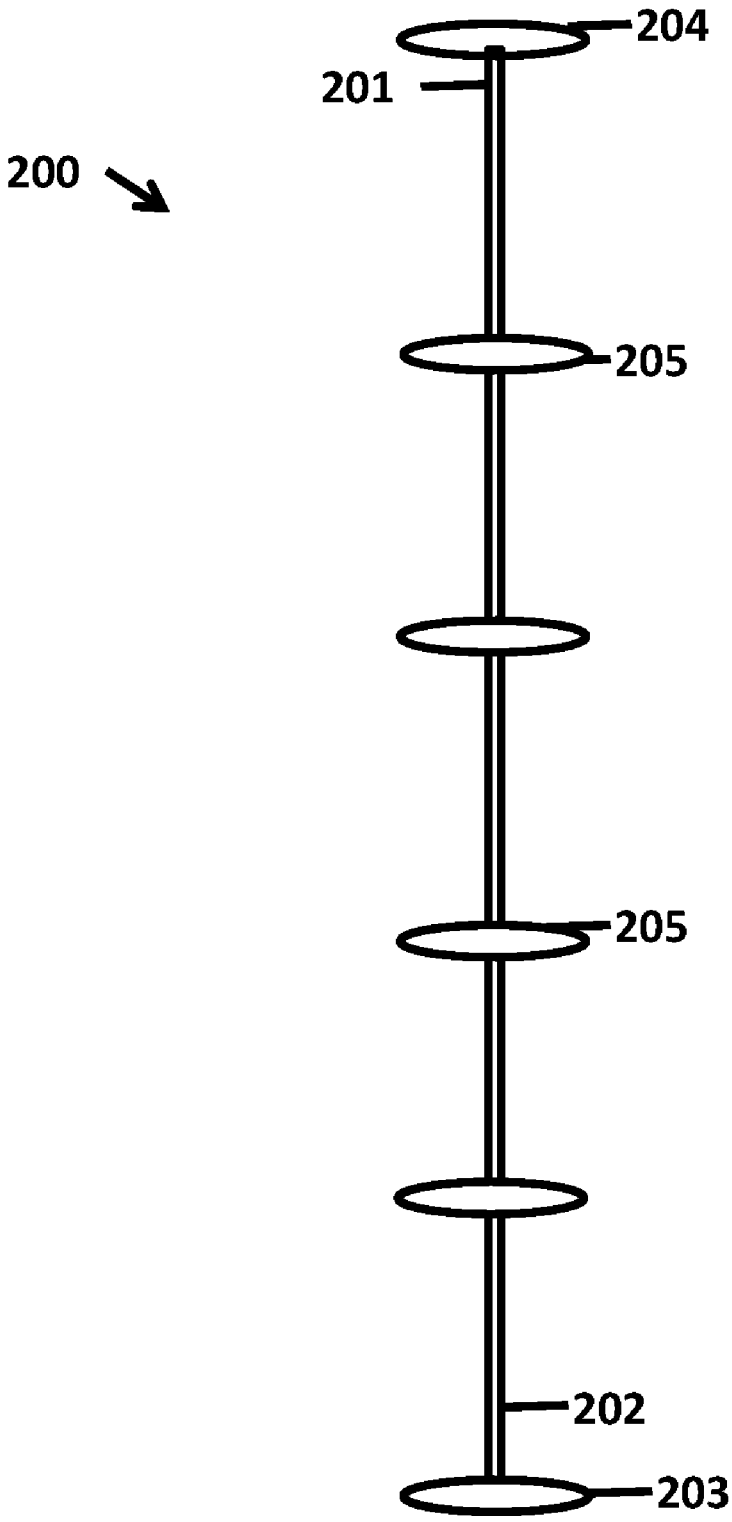
FIG. 2 is a front-view drawing illustrating an exemplary resistance exercise and physical therapy apparatus.

FIG. 2 is a front-view drawing illustrating an exemplary resistance exercise and physical therapy apparatus. The resilient member 200 having a base end 201 and a remote end 202. The resilient member 200 includes a first enlargement 203 at the base end, a second enlargement 204 at the distal end, and spaced-apart third enlargements 205 along the length of the resilient member 200. The first enlargement 203, the second enlargement 204, and the spaced-apart third enlargements 205 each have an oblong shape.

In one embodiment, the resilient member 200 may be made of, for example, a styrene-butadiene rubber or a chloroprene (i.e., neoprene) rubber. The resilient member 200 has excellent memory characteristics and returns to its original shape after numerous elongations.

The resilient member 200 may also be made of any other suitable elastic material, for example, natural rubber, synthetic polyisoprene, butyl rubber, halogenated butyl rubber, polybutyldiene, nitrile butadiene rubber, hydrogenated nitrile rubber, ethylene propylene rubber, epichlorohydrin rubber, polyacrylic rubber, silicone rubber, fluorosilicon rubber, fluoroelastomers, prefluoroelastomers, thermoplastic polyurethane, polyether block amides, chlorosulfonated polyethylene, ethylene-vinyl acetate, and the like, or combinations thereof.

Typical physical properties for a suitable elastic material includes, for example, a polymer specific gravity from about 0.8 to about 2.0, a tensile strength (in pounds per square inch) from about 2000 to about 9000, and a percentage elongation to about 900. The elastic material should also possess, for example, good abrasion resistance, good tear resistance, and good ozone resistance.

In one embodiment, the exemplary resilient member 200 may be, for example, a bungee cord, which is an elastic cord composed of one or more elastic strands forming a core, usually covered in a woven nylon or cotton sheath.

In one embodiment, the first enlargement 203, the second enlargement 204, and each of the one or more spaced-apart third enlargements 205 is made of the elastic material. In one embodiment, the first enlargement 203 and the second enlargement 204 are each made of the elastic material and each of the one or more spaced-apart enlargements 205 are made of a wooden material. In one embodiment, first enlargement 203 and the second enlargement 204 are each made of the elastic material and each of the one or more spaced-apart third enlargements 205 are made of a metal material.

In one embodiment, the first enlargement 203 and the second enlargement 204 are each made of the elastic material and each of the one or more spaced-apart third enlargements 205 are made of a plastic material. In one embodiment, the first enlargement 203 is made of the elastic material and the second enlargement 204 and each of the one or more spaced-apart enlargements 205 are made of a different elastic material. In one embodiment, first enlargement 203 and the second enlargement 204 are each made of a wooden material and each of the one or more spaced-apart third enlargements 205 are made of an elastic material.

In one embodiment, the first enlargement 203 and the second enlargement 204, and each of the one or more spaced-apart enlargements 205 are made of a wooden material. In one embodiment, the first enlargement 203 and the second enlargement 204, and each of the one or more spaced-apart enlargements 205 are made of a metal material. In one embodiment, the first enlargement 203 and the second enlargement 204, and each of the one or more spaced-apart enlargements 205 are made of a plastic material.

Figure 3:
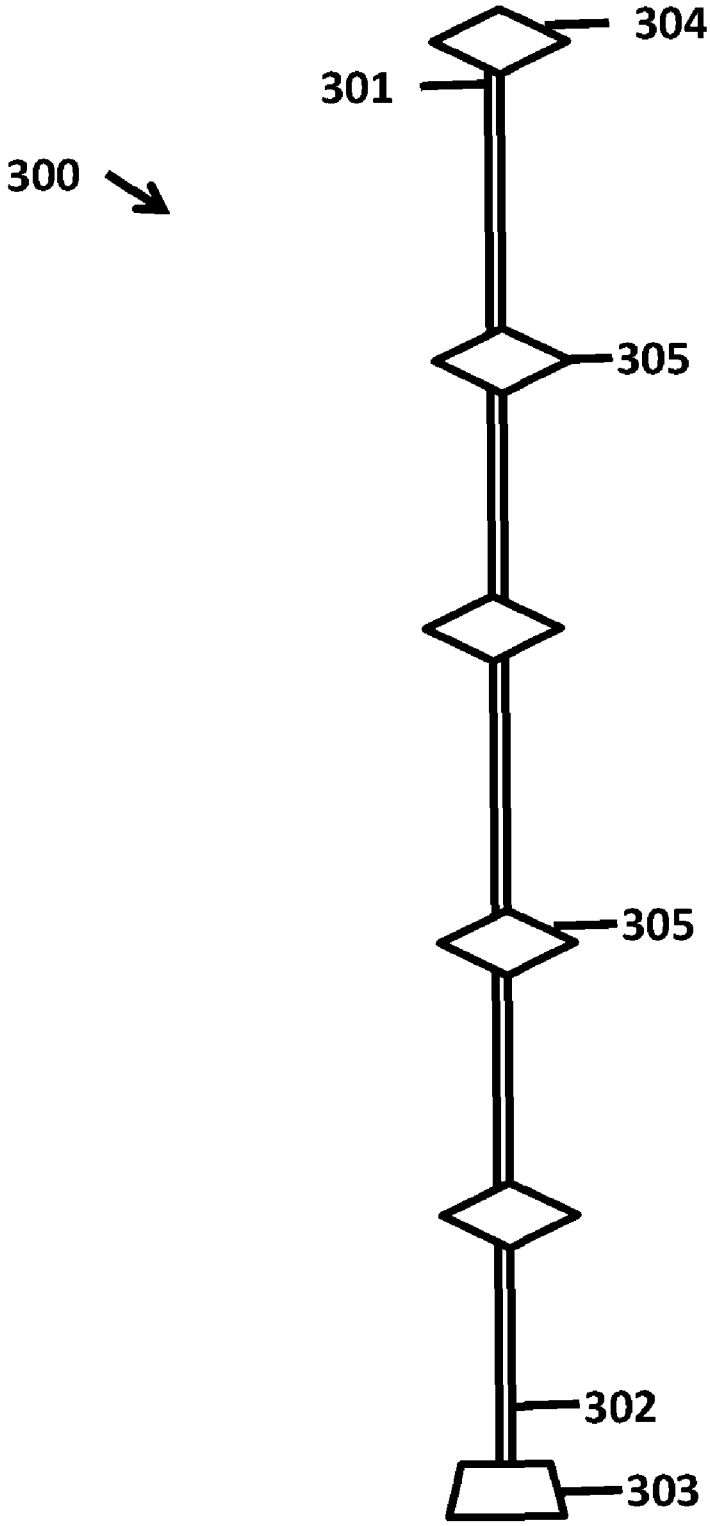
FIG. 3 is a front-view drawing illustrating an exemplary resistance exercise and physical therapy apparatus.

FIG. 3 is a front-view drawing illustrating an exemplary resistance exercise and physical therapy apparatus. The resilient member 300 having a base end 301 and a remote end 302. The resilient member 300 includes a first enlargement 303 at the base end, a second enlargement 304 at the distal end, and spaced-apart third enlargements 305 along the length of the resilient member 300. The first enlargement 303 has a trapezoidal shape while the second enlargement 304 and the spaced-apart third enlargements 305 each have a diamond shape.

In one embodiment, the resilient member 300 may be made of, for example, a styrene-butadiene rubber or a chloroprene (i.e., neoprene) rubber. The resilient member 300 has excellent memory characteristics and returns to its original shape after numerous elongations.

The resilient member 300 may also be made of any other suitable elastic material, for example, natural rubber, synthetic polyisoprene, butyl rubber, halogenated butyl rubber, polybutyldiene, nitrile butadiene rubber, hydrogenated nitrile rubber, ethylene propylene rubber, epichlorohydrin rubber, polyacrylic rubber, silicone rubber, fluorosilicon rubber, fluoroelastomers, prefluoroelastomers, thermoplastic polyurethane, polyether block amides, chlorosulfonated polyethylene, ethylene-vinyl acetate, and the like, or combinations thereof.

Typical physical properties for a suitable elastic material includes, for example, a polymer specific gravity from about 0.8 to about 2.0, a tensile strength (in pounds per square inch) from about 3000 to about 9000, and a percentage elongation to about 900. The elastic material should also possess, for example, good abrasion resistance, good tear resistance, and good ozone resistance.

In one embodiment, the exemplary resilient member 300 may be, for example, a bungee cord, which is an elastic cord composed of one or more elastic strands forming a core, usually covered in a woven nylon or cotton sheath.

In one embodiment, the first enlargement 303, the second enlargement 304, and each of the one or more spaced-apart third enlargements 305 is made of the elastic material. In one embodiment, the first enlargement 303 and the second enlargement 304 are each made of the elastic material and each of the one or more spaced-apart enlargements 305 are made of a wooden material. In one embodiment, first enlargement 303 and the second enlargement 304 are each made of the elastic material and each of the one or more spaced-apart third enlargements 305 are made of a metal material.

In one embodiment, the first enlargement 303 and the second enlargement 304 are each made of the elastic material and each of the one or more spaced-apart third enlargements 305 are made of a plastic material. In one embodiment, the first enlargement 303 is made of the elastic material and the second enlargement 304 and each of the one or more spaced-apart enlargements 305 are made of a different elastic material. In one embodiment, first enlargement 303 and the second enlargement 304 are each made of a wooden material and each of the one or more spaced-apart third enlargements 305 are made of an elastic material.

In one embodiment, the first enlargement 303 and the second enlargement 304, and each of the one or more spaced-apart enlargements 305 are made of a wooden material. In one embodiment, the first enlargement 303 and the second enlargement 304, and each of the one or more spaced-apart enlargements 305 are made of a metal material. In one embodiment, the first enlargement 303 and the second enlargement 304, and each of the one or more spaced-apart enlargements 305 are made of a plastic material.

Figure 4:
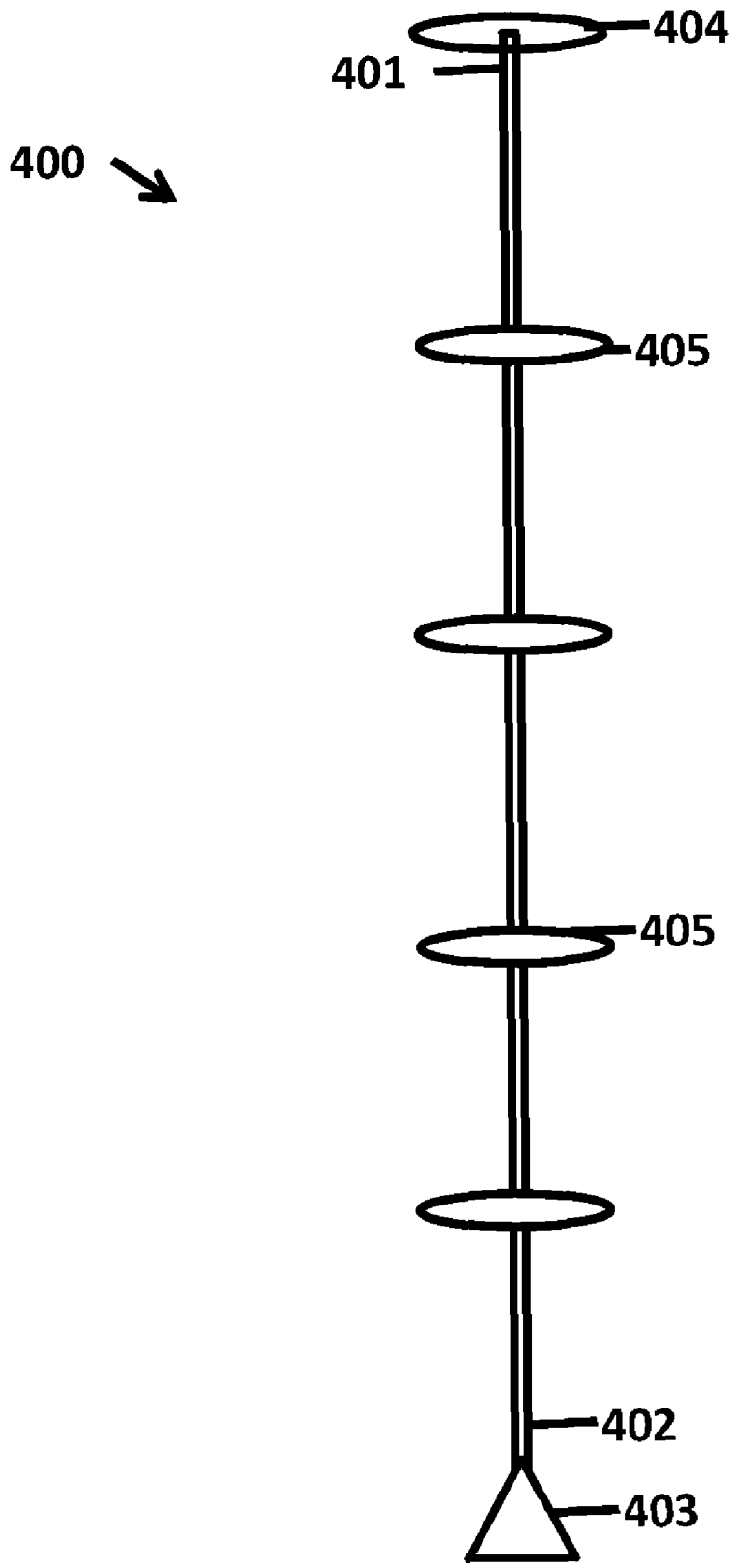
FIG. 4 is a front-view drawing illustrating an exemplary resistance exercise and physical therapy apparatus.

FIG. 4 is a front-view drawing illustrating an exemplary resistance exercise and physical therapy apparatus. The resilient member 400 having a base end 401 and a remote end 402. The resilient member 400 includes a first enlargement 403 at the base end, a second enlargement 404 at the distal end, and spaced-apart third enlargements 405 along the length of the resilient member 400. The first enlargement 403 has a triangular shape while the second enlargement 404 and the spaced-apart third enlargements 405 each have an oblong shape.

In one embodiment, the resilient member 400 may be made of, for example, a styrene-butadiene rubber or a chloroprene (i.e., neoprene) rubber. The resilient member 400 has excellent memory characteristics and returns to its original shape after numerous elongations.

The resilient member 400 may also be made of any other suitable elastic material, for example, natural rubber, synthetic polyisoprene, butyl rubber, halogenated butyl rubber, polybutyldiene, nitrile butadiene rubber, hydrogenated nitrile rubber, ethylene propylene rubber, epichlorohydrin rubber, polyacrylic rubber, silicone rubber, fluorosilicon rubber, fluoroelastomers, prefluoroelastomers, thermoplastic polyurethane, polyether block amides, chlorosulfonated polyethylene, ethylene-vinyl acetate, and the like, or combinations thereof.

Typical physical properties for a suitable elastic material includes, for example, a polymer specific gravity from about 0.8 to about 2.0, a tensile strength (in pounds per square inch) from about 4000 to about 9000, and a percentage elongation to about 900. The elastic material should also possess, for example, good abrasion resistance, good tear resistance, and good ozone resistance.

In one embodiment, the exemplary resilient member 400 may be, for example, a bungee cord, which is an elastic cord composed of one or more elastic strands forming a core, usually covered in a woven nylon or cotton sheath.

In one embodiment, the first enlargement 403, the second enlargement 404, and each of the one or more spaced-apart third enlargements 405 is made of the elastic material. In one embodiment, the first enlargement 403 and the second enlargement 404 are each made of the elastic material and each of the one or more spaced-apart enlargements 405 are made of a wooden material. In one embodiment, first enlargement 403 and the second enlargement 404 are each made of the elastic material and each of the one or more spaced-apart third enlargements 405 are made of a metal material.

In one embodiment, the first enlargement 403 and the second enlargement 404 are each made of the elastic material and each of the one or more spaced-apart third enlargements 405 are made of a plastic material. In one embodiment, the first enlargement 403 is made of the elastic material and the second enlargement 404 and each of the one or more spaced-apart enlargements 405 are made of a different elastic material. In one embodiment, first enlargement 403 and the second enlargement 404 are each made of a wooden material and each of the one or more spaced-apart third enlargements 405 are made of an elastic material.

In one embodiment, the first enlargement 403 and the second enlargement 404, and each of the one or more spaced-apart enlargements 405 are made of a wooden material. In one embodiment, the first enlargement 403 and the second enlargement 404, and each of the one or more spaced-apart enlargements 405 are made of a metal material. In one embodiment, the first enlargement 403 and the second enlargement 404, and each of the one or more spaced-apart enlargements 405 are made of a plastic material.

Figure 5:
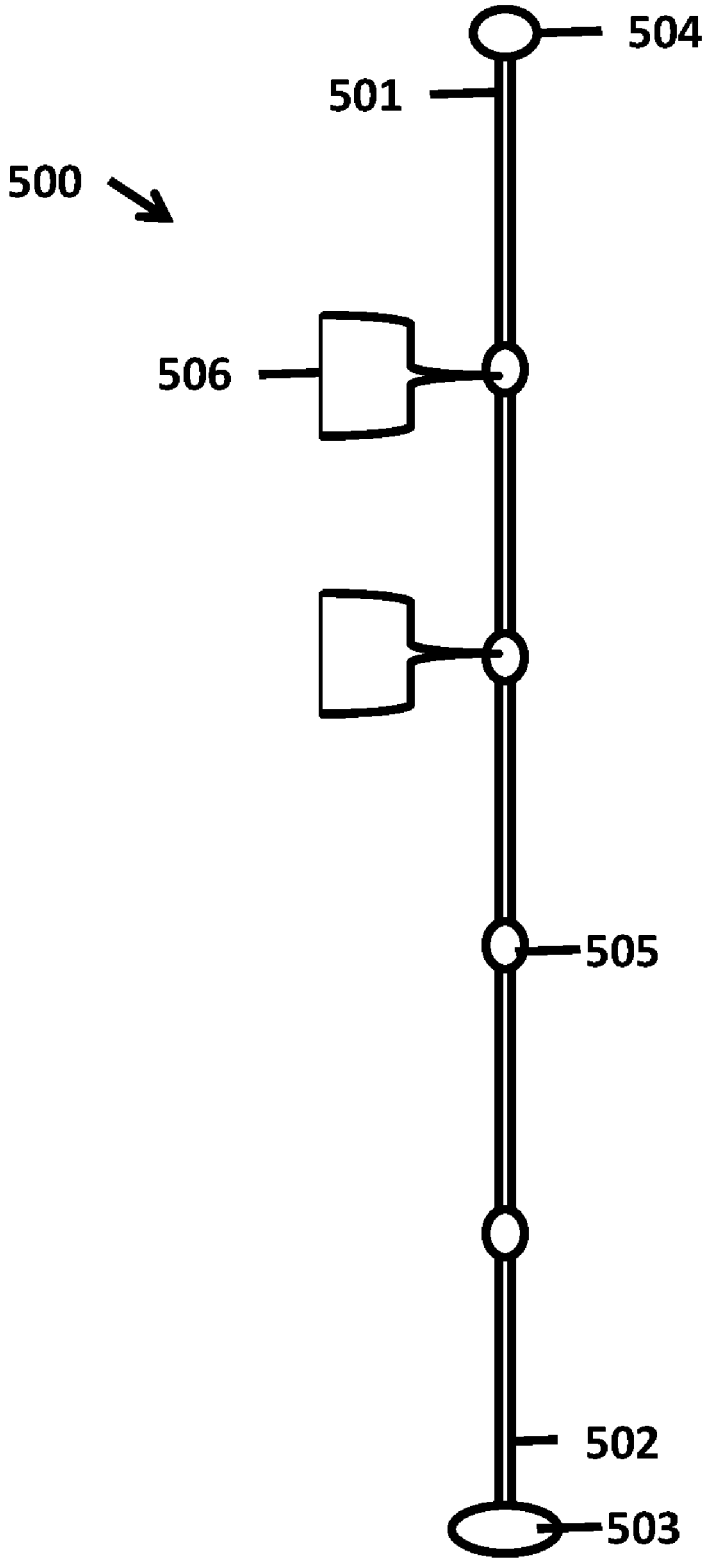
FIG. 5 is a front-view drawing illustrating an exemplary resistance exercise and physical therapy apparatus.

FIG. 5 is a front-view drawing illustrating an exemplary resistance exercise and physical therapy apparatus. The resilient member 500 having a base end 501 and a remote end 502. The resilient member 500 includes a first enlargement 503 at the base end, a second enlargement 504 at the distal end, spaced-apart third enlargements 505 along the length of the resilient member 500, and one or more handles 506 attached to one or more spaced-apart third enlargements 505.

In one embodiment, the resilient member 500 may be made of, for example, a styrene-butadiene rubber or a chloroprene (i.e., neoprene) rubber. The resilient member 500 has excellent memory characteristics and returns to its original shape after numerous elongations.

The resilient member 500 may also be made of any other suitable elastic material, for example, natural rubber, synthetic polyisoprene, butyl rubber, halogenated butyl rubber, polybutyldiene, nitrile butadiene rubber, hydrogenated nitrile rubber, ethylene propylene rubber, epichlorohydrin rubber, polyacrylic rubber, silicone rubber, fluorosilicon rubber, fluoroelastomers, prefluoroelastomers, thermoplastic polyurethane, polyether block amides, chlorosulfonated polyethylene, ethylene-vinyl acetate, and the like, or combinations thereof.

Typical physical properties for a suitable elastic material includes, for example, a polymer specific gravity from about 0.8 to about 2.0, a tensile strength (in pounds per square inch) from about 5000 to about 9000, and a percentage elongation to about 900. The elastic material should also possess, for example, good abrasion resistance, good tear resistance, and good ozone resistance.

In one embodiment, the exemplary resilient member 500 may be, for example, a bungee cord, which is an elastic cord composed of one or more elastic strands forming a core, usually covered in a woven nylon or cotton sheath.

In one embodiment, the first enlargement 503, the second enlargement 504, and each of the one or more spaced-apart third enlargements 505 is made of the elastic material. In one embodiment, the first enlargement 503 and the second enlargement 504 are each made of the elastic material and each of the one or more spaced-apart enlargements 505 are made of a wooden material. In one embodiment, first enlargement 503 and the second enlargement 504 are each made of the elastic material and each of the one or more spaced-apart third enlargements 505 are made of a metal material.

In one embodiment, the first enlargement 503 and the second enlargement 504 are each made of the elastic material and each of the one or more spaced-apart third enlargements 505 are made of a plastic material. In one embodiment, the first enlargement 503 is made of the elastic material and the second enlargement 504 and each of the one or more spaced-apart enlargements 505 are made of a different elastic material. In one embodiment, first enlargement 503 and the second enlargement 504 are each made of a wooden material and each of the one or more spaced-apart third enlargements 505 are made of an elastic material.

In one embodiment, the first enlargement 503 and the second enlargement 504, and each of the one or more spaced-apart enlargements 505 are made of a wooden material. In one embodiment, the first enlargement 503 and the second enlargement 504, and each of the one or more spaced-apart enlargements 505 are made of a metal material. In one embodiment, the first enlargement 503 and the second enlargement 504, and each of the one or more spaced-apart enlargements 505 are made of a plastic material.

Figure 6:
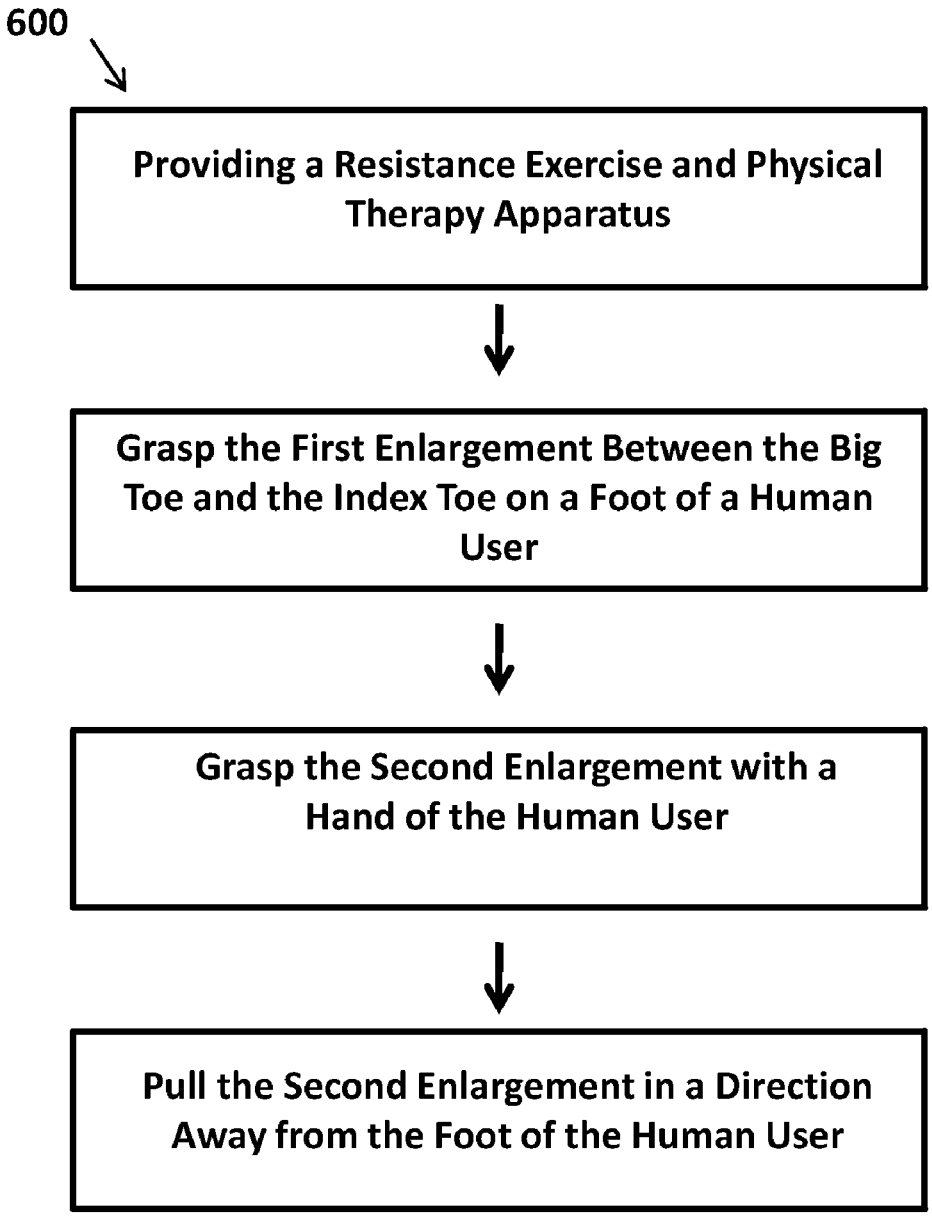
FIG. 6 is a block diagram illustrating an exemplary method of using an exemplary resistance exercise and physical therapy apparatus.

FIG. 6 is a block diagram illustrating an exemplary method of using an exemplary resistance exercise and physical therapy apparatus 600. This method includes providing a resistance exercise and physical therapy apparatus including an elongate resilient member having a proximal end and a distal end, wherein the elongate resilient member includes an elastic material with a first enlargement at the proximal end, a second enlargement at the distal end, and one or more spaced-apart third enlargements along the length of the elongate resilient member, wherein the first enlargement is grasped by a first foot of a human user or by a floor or wall mounted socket; grasping the first enlargement between the big toe and the second toe on the first foot of a human user or inserting the first enlargement into a floor or wall mounted socket; grasping the second enlargement or the one or more spaced apart third enlargements by a hand or a foot of the human user; and pulling the second enlargement or the one or more spaced apart third enlargements in a direction away from the first foot of the human user or the floor or wall mounted socket so that the elongate resilient member is under tension.

The exemplary resistance exercise and physical therapy apparatus, as disclosed herein, may be used in various stretching exercises.

In one embodiment, the user, while standing, grasps the first enlargement of an exemplary resistance exercise and physical therapy apparatus between the big toe and the second toe on the user's right foot and also grasps the second enlargement between the thumb and the index finger on the user's right hand. The user subsequently pulls the exemplary resistance exercise and physical therapy apparatus away from the user's right foot to apply tension to one or more muscles.

In one embodiment, the user, while standing, grasps the first enlargement of an exemplary resistance exercise and physical therapy apparatus between the big toe and the second toe on the user's right foot and also grasps the second enlargement between the thumb and the index finger on the user's left hand. The user subsequently pulls the exemplary resistance exercise and physical therapy apparatus away from the user's right foot to apply tension to one or more muscles.

In one embodiment, the user, while standing, grasps the first enlargement of an exemplary resistance exercise and physical therapy apparatus between the big toe and the second toe on the user's right foot and also grasps the second enlargement between the thumb and the index finger on the user's right hand. The user also grasps the first enlargement of a second exemplary resistance exercise and physical therapy apparatus between the big toe and the second toe on the user's left foot and also grasps the second enlargement between the thumb and the index finger on the user's left hand. The user subsequently pulls the two exemplary resistance exercise and physical therapy apparatuses away from the user's feet to apply tension to two or more muscles.

In one embodiment, the user, while standing, grasps the first enlargement of an exemplary resistance exercise and physical therapy apparatus between the big toe and the second toe on the user's right foot and also grasps the second enlargement between the big toe and the second toe on the user's left foot. The user grasps one or more spaced-apart enlargements with one of more of the users' hands. The user subsequently pulls the exemplary resistance exercise and physical therapy apparatus away from the user's each foot to apply tension to one or more muscles.

In one embodiment, the user, while standing, grasps the first enlargement of an exemplary resistance exercise and physical therapy apparatus between the big toe and the second toe on the user's right foot and also grasps the second enlargement between the big toe and the second on the user's left. The user subsequently moves the user's feet apart to apply tension to one or more muscles.

In one embodiment, the user lies on their back and grasps the first enlargement of an exemplary resistance exercise and physical therapy apparatus between the big toe and the second toe on the user's right foot and also grasps the second enlargement between the thumb and the index finger on the user's right hand. The user subsequently pulls the exemplary resistance exercise and physical therapy apparatus away from the user's right foot to apply tension to one or more muscles.

In one embodiment, the user lies on their back and grasps the first enlargement of an exemplary resistance exercise and physical therapy apparatus between the big toe and the second toe on the user's right foot and also grasps the second enlargement between the thumb and the index finger on the user's left hand. The user subsequently pulls the exemplary resistance exercise and physical therapy apparatus away from the user's right foot to apply tension to one or more muscles.

In one embodiment, the user lies on their back and grasps the first enlargement of an exemplary resistance exercise and physical therapy apparatus between the big toe and the second toe on the user's right foot and also grasps the second enlargement between the thumb and the index finger on the user's right hand. The user also grasps the first enlargement of a second exemplary resistance exercise and physical therapy apparatus between the big toe and the second toe on the user's left foot and also grasps the second enlargement between the thumb and the index finger on the user's left hand. The user subsequently pulls the two exemplary resistance exercise and physical therapy apparatuses away from the user's feet to apply tension to two or more muscles.

In one embodiment, the user lies on their back and grasps the first enlargement of an exemplary resistance exercise and physical therapy apparatus between the big toe and the second toe on the user's right foot and also grasps the second enlargement between the big toe and the second toe on the user's left foot. The user grasps one or more spaced-apart enlargements with one or more of the users' hands. The user subsequently pulls the exemplary resistance exercise and physical therapy apparatus away from the user's each foot to apply tension to one or more muscles.

In one embodiment, the user lies on their back and grasps the first enlargement of an exemplary resistance exercise and physical therapy apparatus between the big toe and the second toe on the user's right foot and also grasps the second enlargement between the big toe and the second on the user's left. The user subsequently moves the user's feet apart to apply tension to one or more muscles.

In one embodiment, the user, while standing, places the first enlargement of an exemplary resistance exercise and physical therapy apparatus in a socket on the floor near the user's right foot and also grasps the second enlargement between the thumb and the index finger on the user's right hand. The user subsequently pulls the exemplary resistance exercise and physical therapy apparatus away from the floor socket to apply tension to one or more muscles.

In one embodiment, the user, while standing, places the first enlargement of an exemplary resistance exercise and physical therapy apparatus in a socket on the floor near and also grasps the second enlargement between the thumb and the index finger on the user's left hand. The user subsequently pulls the exemplary resistance exercise and physical therapy apparatus away from the floor socket to apply tension to one or more muscles.

In one embodiment, the user, while standing, places the first enlargement of an exemplary resistance exercise and physical therapy apparatus in a socket on the floor near the user's right foot and also grasps the second enlargement between the thumb and the index finger on the user's right hand. The user also places the first enlargement of a second exemplary resistance exercise and physical therapy apparatus in a socket on the floor near the user's left foot and also grasps the second enlargement between the thumb and the index finger on the user's left hand. The user subsequently pulls the two exemplary resistance exercise and physical therapy apparatuses away from each floor socket to apply tension to two or more muscles.

In one embodiment, the user, while standing, places the first enlargement of an exemplary resistance exercise and physical therapy apparatus in a socket on the floor near the user's right foot and also places the second enlargement in a socket on the floor near the user's left foot. The user grasps one or more spaced-apart enlargements with one or more of the users' hands. The user subsequently pulls the exemplary resistance exercise and physical therapy apparatus away from each floor socket to apply tension to one or more muscles.

In one embodiment, the user, while standing, places the first enlargement of an exemplary resistance exercise and physical therapy apparatus between the big toe and the second toe on the user's right foot and also places the second enlargement in a socket on the floor near the user's left. The user subsequently pulls the exemplary resistance exercise and physical therapy apparatus away from the floor socket to apply tension to one or more muscles.

In the claims provided herein, the steps specified to be taken in a claimed method or process may be carried out in any order without departing from the principles of the invention, except when a temporal or operational sequence is explicitly defined by claim language. Recitation in a claim to the effect that first a step is performed then several other steps are performed shall be taken to mean that the first step is performed before any of the other steps, but the other steps may be performed in any sequence unless a sequence is further specified within the other steps. For example, claim elements that recite "first A, then B, C, and D, and lastly E" shall be construed to mean step A must be first, step E must be last, but steps B, C, and D may be carried out in any sequence between steps A and E and the process of that sequence will still fall within the four corners of the claim.

Furthermore, in the claims provided herein, specified steps may be carried out concurrently unless explicit claim language requires that they be carried out separately or as parts of different processing operations. For example, a claimed step of doing X and a claimed step of doing Y may be conducted simultaneously within a single operation, and the resulting process will be covered by the claim. Thus, a step of doing X, a step of doing Y, and a step of doing Z may be conducted simultaneously within a single process step, or in two separate process steps, or in three separate process steps, and that process will still fall within the four corners of a claim that recites those three steps.

Similarly, except as explicitly required by claim language, a single substance or component may meet more than a single functional requirement, provided that the single substance fulfills the more than one functional requirement as specified by claim language.

All patents, patent applications, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety. Additionally, all claims in this application, and all priority applications, including but not limited to original claims, are hereby incorporated in their entirety into, and form a part of, the written description of the invention.

Applicants reserve the right to physically incorporate into this specification any and all materials and information from any such patents, applications, publications, scientific articles, web sites, electronically available information, and other referenced materials or documents. Applicants reserve the right to physically incorporate into any part of this document, including any part of the written description, the claims referred to above including but not limited to any original claims.

What is claimed is:

1. A resistance exercise and physical therapy apparatus comprising:

an elongate resilient member having a proximal end and a distal end, wherein the elongate resilient member comprises an elastically flexible material;

a first enlarged portion of the elongate resilient member that is located at the proximal ends;

a second enlarged portion of the elongate resilient member that is located at the distal end; and one or more spaced-apart third enlarged portions along the length of the elongate resilient member wherein the first enlarged portion comprises:

a first generally flat surface facing oppositely away from the second enlarged portion, and a second generally flat surface that is parallel to the first generally flat surface and facing oppositely away from the first generally flat surface, wherein the elongate resilient member extends axially away from the second generally flat surface in a direction opposite from the first generally flat surface, wherein the first enlarged portion has a height defined by a distance between the first generally flat surface and the second generally flat surface, the height of the first enlarged portion being configured so that, when the first enlarged portion is placed in a cavity between a user's big toe and adjacent second toe so that the second generally flat surface engages a bottom of the user's foot, the first generally flat surface does not extend beyond a plane defined by portions of the user's foot that contact a surface when the user is standing on the surface, and wherein the second generally flat surface has a shape and size configured to be anchored by one or more bones of the user's foot when the second generally flat surface engages a bottom of the user's foot.

2. The resistance exercise and physical therapy apparatus of claim 1, further comprising one or more handles attached to the first enlarged portion, the second enlarged portion, the one or more third enlarged portions, or a combination thereof.

3. The resistance exercise and physical therapy apparatus of claim 1, wherein the second enlarged portion or one or more spaced-apart third enlarged portions have a shape and size configured to be grasped by one or more of the user's hands.

4. The resistance exercise and physical therapy apparatus of claim 1, wherein the second enlarged portion has a shape and size configured to be grasped by the user's other foot.

5. The resistance exercise and physical therapy apparatus of claim 4, wherein the shape and size of the second enlarged portion is configured to be anchored by one or more bones of the user's other foot when the second enlarged portion is placed in a cavity between the user's big toe and adjacent second toe of the user's other foot.

6. The resistance exercise and physical therapy apparatus of claim 4, wherein the second enlarged portion comprises a generally flat surface that is configured to conform to a floor surface when the user is standing on the floor surface with the second enlarged portion placed in a cavity between the user's big toe and adjacent second toe of the user's other.

7. The resistance exercise and physical therapy apparatus of claim 6, wherein the generally flat surface comprises a non-slip surface.

8. The resistance exercise and physical therapy apparatus of claim 1, further comprising one or more tubular pads are independently interspaced between the first enlarged portion, the second enlarged portion, the one or more spaced apart third enlarged portions, or a combination thereof, wherein the one or more tubular pads independently sheath the elongate resilient member.

9. The resistance exercise and physical therapy apparatus of claim 1, wherein the first enlarged portion, the second enlarged portion, and the one or more spaced apart third enlarged portions each have equal thicknesses.

10. The resistance exercise and physical therapy apparatus of claim 1, further comprising one or more handles attached to the elongate resilient member.

11. The resistance exercise and physical therapy apparatus of claim 1, wherein a total surface area of the second generally flat surface is smaller than a total surface area of the first generally flat surface; and wherein the first enlarged portion further comprises a tapered sidewall of the first enlarged portion that extends from an outer perimeter of the second generally flat surface toward an outer perimeter of the first generally flat surface.

12. The resistance exercise and physical therapy apparatus of claim 1, wherein the elongate resilient member comprises a cord having a diameter that is configured to fit between the user's big toe and adjacent second toe.

13. The resistance exercise and physical therapy apparatus of claim 1, wherein the elastically flexible material has a tensile strength from about 1,000 pounds per square inch to about 9,000 pounds per square inch.

14. The resistance exercise and physical therapy apparatus of claim 1, the one or more third enlargements having lengths that are measured on an axis along which the elongate resilient member extends from the first enlargement to the second enlargement, the one or more third enlargements having widths that are measured perpendicular to the axis, wherein the widths are greater than or equal to the lengths.

15. A method of resistance exercise and physical therapy comprising:

providing a resistance exercise and physical therapy apparatus comprising:

an elongate resilient member having a proximal end and a distal end, wherein the elongate resilient member comprises an elastically flexible material;

a first enlarged portion of the elongate resilient member that is located at the proximal end;

a second enlarged portion of the elongate resilient member that is located at the distal end; and one or more spaced-apart third enlarged portions along the length of the elongate resilient member;

wherein the first enlarged portion comprises:

a first generally flat surface facing oppositely away from the second enlarged portion, and a second generally flat surface that is parallel to the first generally flat surface and facing oppositely away from the first generally flat surface, wherein the elongate resilient member extends axially away from the second generally flat surface in a direction opposite from the first generally flat surface, wherein the first enlarged portion has a height defined by a distance between the first generally flat surface and the second generally flat surface, the height of the first enlarged portion being configured so that, when the first enlarged portion is placed in a cavity between a user's big toe and adjacent second toe so that the second generally flat surface engages a bottom of the user's foot, the first generally flat surface does not extend beyond a plane defined by portions of the user's foot that contact a surface when the user is standing on the surface, and wherein the second generally flat surface has a shape and size configured to be anchored by one or more bones of the user's foot when the second generally flat surface engages a bottom of the user's foot;

grasping the first enlarged portion in the cavity between the user's big toe and the adjacent second toe of the user's foot;

grasping the second enlarged portion or the one or more spaced apart third enlarged portions with at least one of the user's hands or with the user's other foot; and pulling the second enlarged portion or the one or more spaced apart third enlarged portions in a direction away from the first enlarged portion as anchored by the one or more bones of the user's foot.

16. The method of claim 15, further comprising directing the second enlarged portion or the one or more spaced apart third enlarged portions in an opposite direction toward the first enlarged portion to release the tension on the elongate resilient member.

17. The method of claim 15, wherein a total surface area of the second generally flat surface is smaller than a total surface area of the first generally flat surface; and wherein the first enlarged portion further comprises a tapered sidewall of the first enlarged portion that extends from an outer perimeter of the second generally flat surface toward an outer perimeter of the first generally flat surface.

18. The method of claim 15, wherein the elongate resilient member comprises a cord having a diameter that is configured to fit between the user's big toe and adjacent second toe.

19. A resistance exercise and physical therapy kit comprising:

a resistance exercise and physical therapy apparatus comprising:

an elongate resilient member having a proximal end and a distal end, wherein the elongate resilient member comprises an elastically flexible material;

a first enlarged portion of the elongate resilient member that is located at the proximal end;

a second enlarged portion of the elongate resilient member that is located at the distal end; and one or more spaced-apart third enlarged portions along the length of the elongate resilient member;

wherein the first enlarged portion comprises:

a first generally flat surface facing oppositely away from the second enlarged portion, and a second generally flat surface that is parallel to the first generally flat surface and facing oppositely away from the first generally flat surface, wherein the elongate resilient member extends axially away from the second generally flat surface in a direction opposite from the first generally flat surface, wherein the first enlarged portion has a height defined by a distance between the first generally flat surface and the second generally flat surface, the height of the first enlarged portion being configured so that, when the first enlarged portion is placed in a cavity between a user's big toe and adjacent second toe so that the second generally flat surface engages a bottom of the user's foot, the first generally flat surface does not extend beyond a plane defined by portions of the user's foot that contact a surface when the user is standing on the surface, and wherein the second generally flat surface has a shape and size configured to be anchored by one or more bones of the user's foot when the second generally flat surface engages a bottom of the user's foot; and a set of instructions that instruct the user how to perform specific exercises or physical therapies using the resistance exercise and physical therapy apparatus.

20. The resistance exercise and physical therapy kit of claim 19, wherein a total surface area of the second generally flat surface is smaller than a total surface area of the first generally flat surface; and wherein the first enlarged portion further comprises a tapered sidewall of the first enlarged portion that extends from an outer perimeter of the second generally flat surface toward an outer perimeter of the first generally flat surface.

* * * * *

UNITED STATES PATENT AND TRADEMARK OFFICE

CERTIFICATE OF CORRECTION

PATENT NO. : 8,157,712 B1
APPLICATION NO. : 12/962974
DATED : April 17, 2012
INVENTOR(S) : Nicholas R. Musachio It is certified that error appears in the above-identified patent and that said Letters Patent is hereby corrected as shown below:

Claim 1, Column 18, Line 50, delete “ends;” and insert --end;--, therefor.

Claim 1, Column 18, Line 54, delete “member” and insert --member;--, therefor.

Claim 6, Column 19, Line 35, delete “other.” and insert --other foot.--, therefor.

Signed and Sealed this
Twenty-sixth Day of June, 2012

David J. Kappos

David J. Kappos
*Director of the United States Patent and Trademark Office*